United States Patent [19]

Joa et al.

[11] Patent Number: 4,497,448

[45] Date of Patent: Feb. 5, 1985

[54] OFFSET ORBIT FLUFF GENERATOR

[75] Inventors: Curt G. Joa, Ocean Ridge, Fla.; Edmund Radzins, Sheboygan Falls, Wis.

[73] Assignee: Curt G. Joa, Inc., Sheboygan Falls, Wis.

[21] Appl. No.: 474,752

[22] Filed: Mar. 14, 1983

[51] Int. Cl.[3] ..... B02C 13/286

[52] U.S. Cl. ..... 241/186.4; 241/189 R

[58] Field of Search ..... 241/273.2, 73, 186 R, 241/186.2, 186.4, 101.7, 189 R, 190, 277, 101 A

[56] References Cited

U.S. PATENT DOCUMENTS 2,352,122 6/1944 Richardson ..... 241/273.2 X 3,967,785 7/1976 Grosch ..... 241/186 R X

*Primary Examiner*—Mark Rosenbaum

*Attorney, Agent, or Firm*—Fuller, House & Hohenfeldt

[57] ABSTRACT

Apparatus for converting bales of wood pulp sheets to fluff. There is a non-rotating horizontal bed plate having a port through which the cutter tips of a cutting mill project from below. A cylindrical casing is journalled on its lower rim for rotation above said bed plate about a vertical axis that is perpendicular to the bed plate. Sets of guide means are mounted to the interior of the casing. Each guide means set holds a bale such that the bales are prevented from centrifuging radially outwardly but can settle on the bed plate. The guide means are located so they keep all portions of the areas of the bales offset or radially spaced from the casing axis in which case the bales are driven in an orbital path as they are swept over the cutting mill.

3 Claims, 5 Drawing Figures

OFFSET ORBIT FLUFF GENERATOR

BACKGROUND OF THE INVENTION

This invention relates to apparatus for disintegrating bales of wood pulp sheets into their constituent cellulosic fibers. This kind of apparatus is also known as a fluff generator. The fibers agglomerate to form a fluffy mass which is used as a fluid absorbent layer in such body worn articles as disposable sanitary napkins and diapers.

The invention disclosed herein is an improved version of a fluff generator that is described in U.S. Pat. No. 3,967,785 which issued to G. S. Grosch and is assigned to Curt G. Joa, Inc., as is the interest of one of the joint inventors in the present application. U.S. Pat. No. 3,967,785 is incorporated herein by reference.

The cited patent discloses a fluff generator comprised of a circular stationary horizontal bed plate. The plate has an elongated opening or port in it. The port extends radially on both sides of the bed plate center. There is a shaft journaled for rotation about a horizontal axis below the bed plate in parallelism with the port. The shaft carries a generally cylindrical cutting mill constituted by a plurality of blades that have cutting edges at the periphery. The cutting edges extend through the port sufficiently far to bite into the bottom pulp sheet in a stack or bale of such sheets that is on the bed plate and is rotated about a vertical axis to sweep it over the mill.

Above the bed plate there is a hollow cylinder or tub having an open top and bottom. The tub is supported on rollers about its lower rim and is power driven at nominal speed for causing it to rotate about a vertical axis. The tub has guide means in it for retaining a single pulp bale against lateral movement and for guiding the bale so it settles on the bed plate. The center of the usually square bale is coincident with the virtual vertical rotational axis of the tub. Thus, rotation of the tub over the bed plate causes the bottom sheet of the pulp bale to sweep over the cutting edges of the mill extending through the port to thereby disintegrate the pulp sheet or sheets at the bottom of the bale into fibers. In the patented apparatus, the axial length of the cutting mill is long enough to have it interface with the full distance from the center of the bale to a corner thereof, that is, the mill is long enough to reach over the diagonal or maximum dimension of the bale.

Although the patented design produced good results in practical applications, it was perceived to be subject to improvement. One of its weaknesses is that the bottom of the bale tends to cavitate or form a dish-shaped concavity during operation. The reason appears to be that the center part of the rotating bale was over the radially inner end of the mill for a greater length of time than the more radially outward perimeter and corners of the lower end of the bale. This cavitation phenomena resulted in something less than optimum output of fluff from the apparatus.

SUMMARY OF THE INVENTION

In accordance with the invention, instead of having a single bale turning and sweeping about an axis that is coincident with the vertical rotational axis of the tub, a plurality of bales are processed at one time and each of them is offset relative to the axis of rotation so that instead of simply turning, they follow an orbital path as they are swept over the high speed rotating mill. In other words, the bales are offset from the center of tub rotation so the mill is not acting on the center of any one of them constantly and, hence, no cavitation or dishing can occur. The bottom layer of the bale that interfaces with the milling cutters is cut away at a substantially uniform pace.

Further in accordance with the invention the plurality of bales are restrained during their orbital movement by guide means which prevent the bales from being centrifuged radially outwardly but permit the bales to settle on the bed plate as they are continuously consumed. The guide means are mounted to the interior of the rotating tub or cylindrical casing and means are provided for adjusting the guide means in a set for each bale radially inwardly and outwardly to accommodate bales of different sizes.

How the foregoing and other features of the improved fluff generator are achieved will appear in the description of a preferred embodiment of the invention which will now be set forth in reference to the drawings.

DESCRIPTION OF THE DRAWINGS

FIG. 2 is a plan view of the apparatus in FIG. 1 with the bale loading device depicted in the preceding figure omitted;

DESCRIPTION OF A PREFERRED EMBODIMENT

Figures 1, 3:
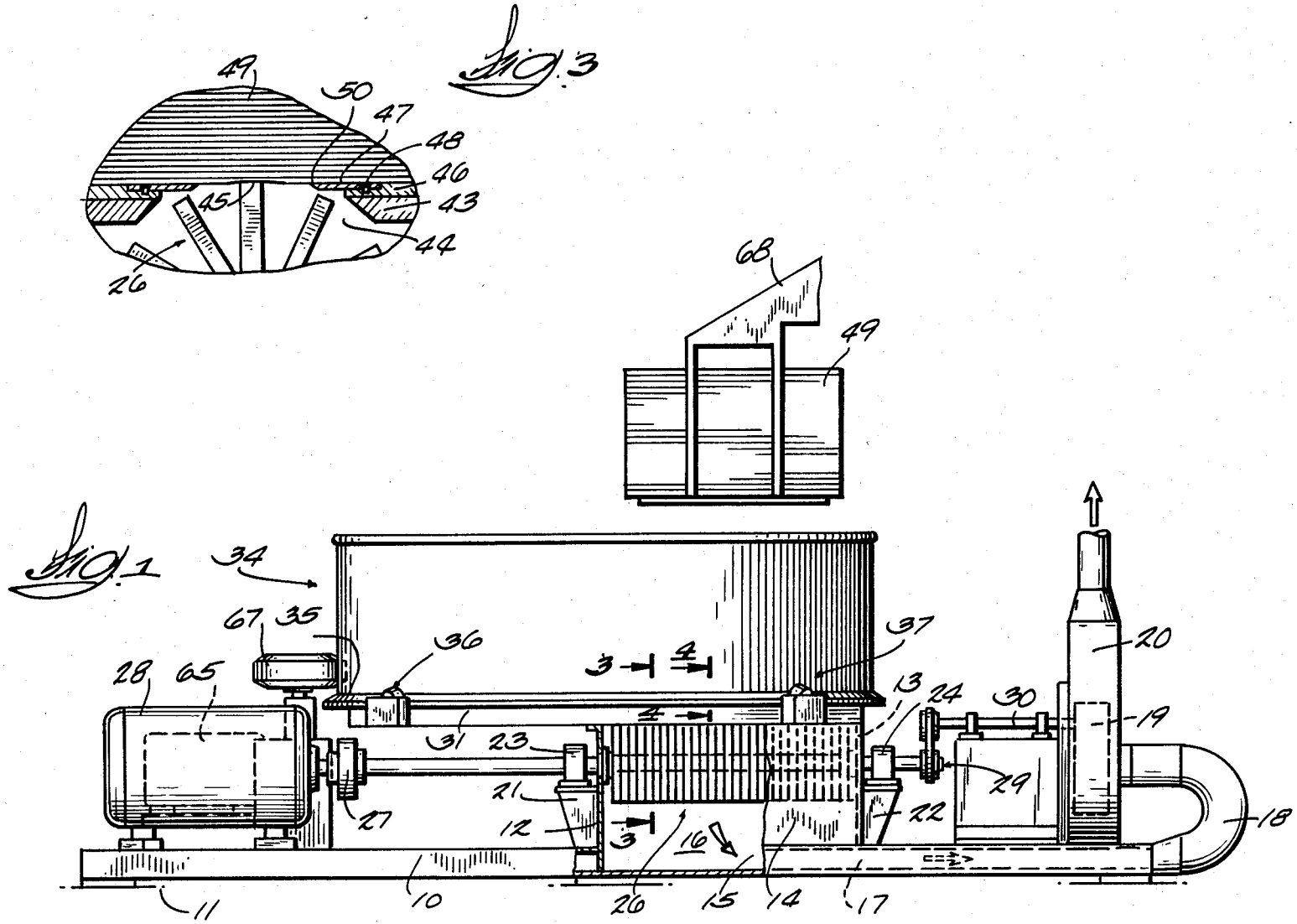
FIG. 1 is a side elevation view of the improved pulp disintegrator or fluff generator.
FIG. 3 is a partial vertical section taken through part of the cutter mill and the bed plate of the apparatus showing the port for the cutters and a fragment of a stack or bale of pulp sheets.

Referring to FIG. 1, the fluff generator comprises a base 10 that is anchored to the floor 11 of a building. A pair of vertical end walls 12 and 13 and front and rear walls 14 and 15, respectively, define a hollow box-like structure whose interior volume is marked 16. The mass of fibers or fluff that is produced in the apparatus passes into volume 16 as indicated by the arrow and enters a channel 17 in the base which serves as a duct for conducting the fluff, by way of a curved duct 18 to the suction inlet of a fan 19. The fan outlet is coupled to a pipe 20 which transports the fluff to a fluff utilizing machine such as a diaper making machine, not shown. A screen, not shown, may be disposed across volume 16 to further break up fibers that may have formed clumps.

A pair of brackets 21 and 22 support bearings 23 and 24 for a shaft 25 whose axis is substantially horizontal. A cutting mill, designated generally by the numeral 26 is mounted to shaft 25 for rotation therewith. The mill will be described later in more detail.

By way of a coupling 27, horizontal shaft 25 is coupled to an electric motor 28. By way of example, in a practical embodiment, motor 28 rotates mill 26 at about 3500 rpm. With the mill having a maximum circumference of about 5 feet, the blade tip peripheral speed is about 17,500 feet per minute (fpm). These speeds are given by way of example and not limitation.

Mill shaft 25 has a speed reducing pulley and belt assembly 29 at its end most remote from the motor 28. The speed reducer drives a shaft 30 for fan 19 which draws the fluff from volume 16 and discharges it to a point of utilization by way of pipe 20.

Figure 4:
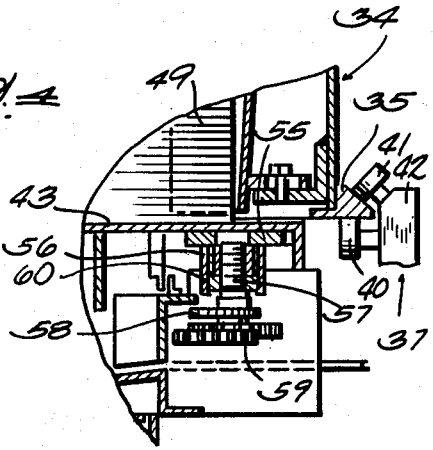
FIG. 4 is a fragmentary section taken on a line corresponding to 4—4 in FIG. 1 and illustrates the mechanism for adjusting the level of the bed plate to thereby adjust the depth of cut by the milling cutters in the bottom of the bale.
Figure 1:
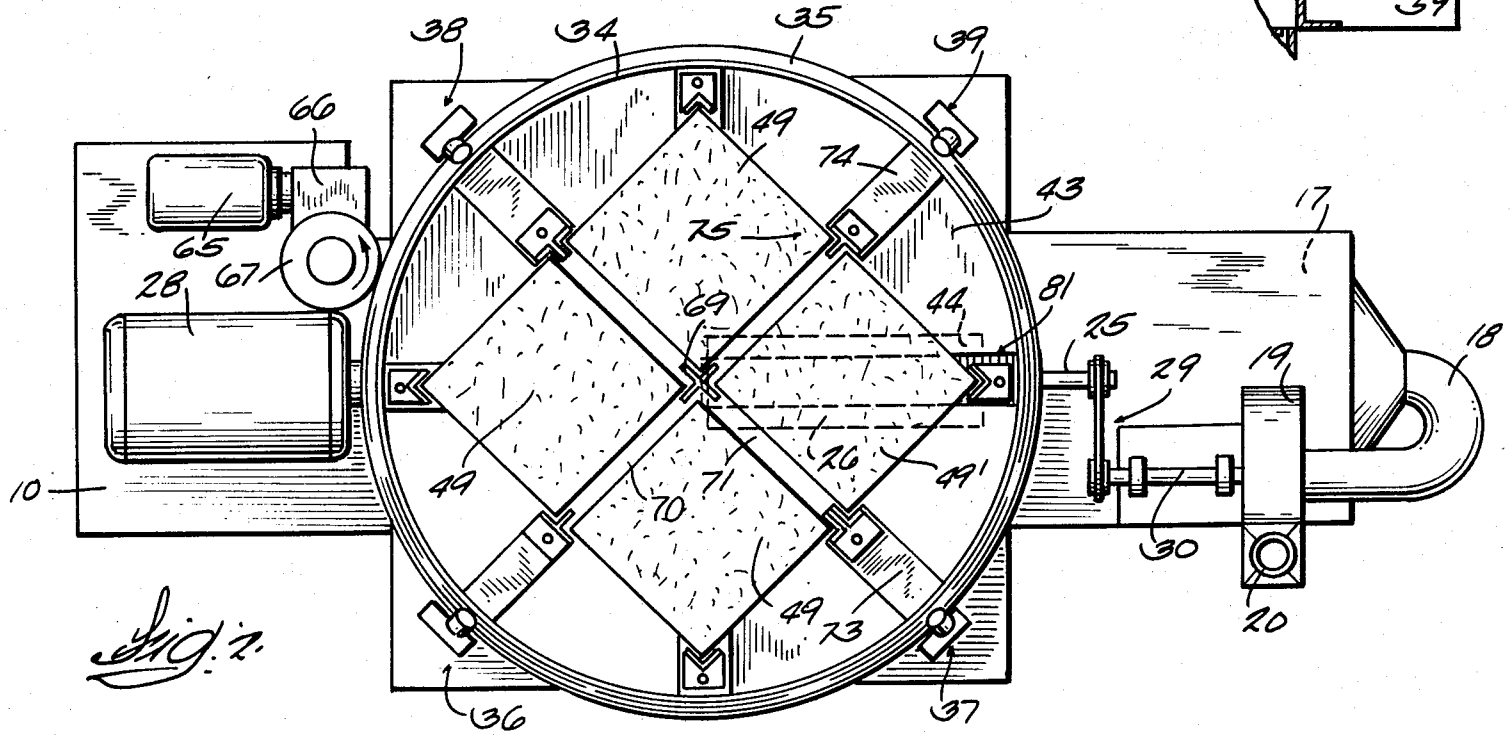

There is a horizontally extending beam structure 31 supported from the base box that contains cutting mill 26. A cylindrical casing or tub 34 is mounted for rotation on beam structure 31 about a virtual vertical axis passing through the center of the tub. The tub has an open top and an open bottom. A beveled ring 35 is fastened to the outside periphery or lower rim of tub 34. The ring runs on roller assemblies two of which, 36 and 37, are visible in FIG. 1 and the other two of which, 38 and 39, are visible in FIG. 2 as well. The beveled rim or ring 35 is shown in detail in FIG. 4. The rim runs on one set of horizontal shaft rollers 40 which accept the gravitational load of the tub. The bevel surface of the ring 35 has rollers 41 rolling on it and these rollers prevent the tub 34 from shifting laterally while it is being rotated about its vertical axis. The pairs of rollers 40 and 41 are mounted to brackets 42 which are fastened to beam structure 31. As shown in FIG. 4 primarily and in FIG. 3 as well, there is a horizontally extending bed plate 43 supported from the beam structure right below the open bottom of tub 35. As shown in FIG. 3, the bed plate has an aperture or port 44 through which the cutting blade tips 45 of the mill 26 extend. A plate 46 is recessed in bed plate 43 around port 44 and a pair of straight stationary knives such as the one marked 47 are secured in the insert with screws 48. A part of a stack or bale of pulp sheets is shown in FIG. 3 and marked 49. The cutting tips or blade ends 45 of mill 26 clear the sharp and beveled edges 50 of knives 47 by about $\frac{1}{8}$–$\frac{1}{4}$ inch by way of example. This results in shearing action of the rotary mill blades on the pulp particles between the rotary blade cutters and the knife edges 50.

Referring to FIG. 4 again it will be seen that horizontal bed plate 43 is provided with means for adjusting its elevation. The purpose is to adjust the depth of cut which the tips or cutting edges of the rotary mill 26 makes in the stacked or baled sheets of pulp 49.

As shown in FIG. 4, the elevation of bed plate 43 is made adjustable by mounting the plate on four spaced apart support pads 55, one of which is visible in FIG. 4. There is a nut 56 in each support pad. Through the thread in each nut 56 a jack screw 57 extends and is journaled in a bearing 60 affixed to pad 55. The screw jack is restrained from axial movement but is permitted to rotate. The screw jacks are interconnected by a series of chains one of which is shown fragmentarily in FIG. 4 and is marked 58. Gears 59 drive one screw jack 57 rotationally with power means, not shown, and they are all linked together by means of chains 58 so the screws turn in synchronism and maintain the bed plate level as it is raised and lowered. The bed plate elevation adjusting means, that is, the screw jacks, are described in cited U.S. Pat. No. 3,967,785 in considerable detail and are shown in FIGS. 3 and 18 in detail. The elevating means is not a new feature in the fluff generator being described herein.

The cutting mill 26 has only been depicted herein diagrammatically rather than in detail. Rotary cutting mills which can be used are illustrated in FIGS. 3, 6, 11 and an alternative form in FIGS. 12 and 13 of the cited prior patent.

Referring to FIGS. 1 and 2 herein, a motor 65 is provided for rotating tub 34 about a vertical axis. The motor provides input power to a speed reduction and shifting mechanism symbolized by the block marked 66. The output from this mechanism rotates a rubber wheel like a tire whose periphery is in frictional contact with the outside periphery of tub 35. The tub drive mechanism is shown in FIG. 7 of the cited prior patent in substantial detail and need not be described further here since it is not a new feature in the present invention. In an actual embodiment, tub 34 is rotated at about 10 rpm in a case where the tub diameter is about 100 inches.

As shown in FIG. 1, bales or compacted stacks of pulp sheets 49 are admitted through the top opening of tub 34 to the tub for being disintegrated by the rotating mill 26. The loading device 68 over the tub 34 need not be described in detail since it can be devised by a skilled mechanic who might want to derive suggestions for its design from the cited prior patent.

Figure 5:
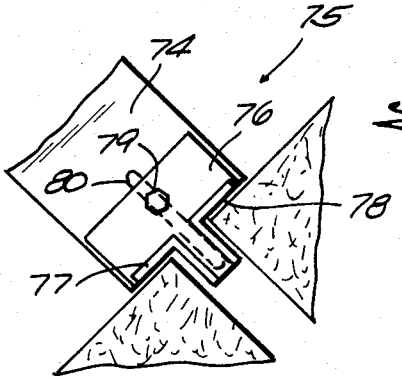
FIG. 5 is an enlarged fragmentary view of the elements for adjusting the bale guide means to accommodate bales of different sizes.

Most of the machine elements that have been described thus far are present in the machine described in the cited prior patent but they are now rearranged and reconfigured in the presently described fluff generator to enhance its productivity and overcome the cavitation problem that existed in the previously patented design. Refer to FIG. 2 which is a view looking into the open top of rotary tub 34. One may see that the tub contains four bales of pulp sheets each of which is marked 49. These bales are resting on non-rotating bed plate 43 which is below the open bottom of the tub. One of the bales 49' is presently being swept over port 44 in the bed plate 43 and, of course, over the peripheral cutters of rotary mill 26. At the center of the tub where the four corresponding inside corners of the bales 49 almost meet, there is an upstanding post or guide member 69 which has a cruciform cross section to provide right-angular recesses in which the corners of the respective bales can nest. The center guide member 69 is supported on cross members 70 and 71 which are raised above the bottom of the tubs so they are not struck by the rotating cutting mill 26 when the tub rotates on its rim about a vertical axis. The cross bars 70 and 71 are fastened to bracket members such as those marked 73 and 74. These bracket members are fastened to the inner periphery of tub 34 and are above the plane of the bottom of the tub and, hence, above the plane of the bed plate by a sufficient amount for the rotary cutting mill 26 to be cleared by them when the tub rotates. Each of the bracket members has an adjustable tongue arrangement at its end such as the one marked 75 that is affilitated with bracket member 74. Its construction is shown in greater detail in FIG. 5. It comprises a member that has a flat base 76 and upstanding right angular guide elements 77 and 78. The base element has a hole through which a bolt 79 projects. The bolt also passes through an elongated slot 80 in bracket member 74. It will be evident that if bolt 79 is loosened, the base 76 and angle members 77 and 78 which are fastened to it can be moved radially inwardly or outwardly relative to the central cruciform guide member 69 in which case the spacing between these elements can be adjusted to accommodate pulp bales of different widths. Guide members such as the one marked 81 are provided for engaging the outer corners of the respective bales 49. The construction of these guide elements 81 is such that they function comparably to the ones marked 75 so their structure need not be described in detail. It is sufficient to recognize that all of the elements have some kind of angular member in which the corners of the bale can nest so that the bales do not wobble freely or become centrifuged radially outwardly due to rotation of the tub. Another characteristic the guide members must have is to let the bales settle freely as their bottom sheets are consumed or disintegrated by the rotary cutting mill 30.

The important feature of the invention is having all portions of the area of each bale be offset or at a radial distance from the center cruciform guide member 69 which is equivalent to saying that the entire area of the bales are radially spaced or offset from the center of tub rotation. This means that when the tub rotates, all parts of the bale will orbit about the center of rotation instead of having a single bale centered for rotation on the rotational axis of the tub as is the case in the apparatus described in the cited prior patent. Thus, in the new apparatus the bottom of the bales sweep more nearly linearly over the cutting mill so more uniform cutting action is obtained.

Having the bales orbit about the tub axis as they are swept over the rotary cutting mill 26 avoids the problem of cavitation. Moreover, if along the diagonal or between sides of the bale there is a tendency for the rotary cutter to penetrate into the bale more rapidly at one end than the other, on following revolutions the least cut end will be sheared off so the bottom of the bale that interfaces with the cutter will be restored very quickly to parallelism with the sheets that are above it.

Of course, the tub diameter in the presently disclosed embodiment must be greater than the diameter of the tub in the cited prior patent, assuming bales of the same size are under consideration in both cases. However, with a relatively small increase in tub diameter the new construction affords an opportunity to disintegrate a plurality of bales at one time so output is increased disproportionately to the increase in its size. Moreover, it is not necessary to reload the drum as frequently for a given output.

Although a preferred embodiment of the invention has been described in detail, such description is intended to be illustrative rather than limiting, for the invention may be variously embodied and is to be limited only by interpretation of the claims which follow.

We claim:

1. Apparatus for disintegrating wood pulp sheets into their constituent fibers, said sheets being stacked congruently to form bales having generally planar bottom faces, said apparatus comprising:

tub means having a hollow interior and a bottom opening lying in a horizontal plane, means mounting said tub means for rotation about a vertical axis that is central to said interior and perpendicular to the horizontal plane of said bottom, a planar bed below said bottom having a port therein, a power driven cutting mill having radially extending blades, said mill being mounted for rotating about a horizontal axis in parallelism with the bed, the blades of said cutting mill extending through said port for performing a cutting action on bales bearing on said bed, a plurality of guide means mounted to the interior of said tub means and arranged around its axis of rotation for retaining a corresponding plurality of bales against radial movement and permitting vertical movement such that the bottom surfaces of said bales may settle on said bed, said guide means being arranged such that all portions of the bottom surface of each bale is offset radially outwardly from the tub means axis of rotation, and power means for rotating said tub means about said vertical axis so the retained bales will move in an orbital path radially offset from said axis to thereby sweep said bales successively over said cutting mill blades for said cutting action to occur over the entire bottom surface of each bale.

2. Apparatus for disintegrating stacks of wood pulp sheets into their constituent fibers, comprising:

a cylindrical casing having upper and lower end openings, the lower end opening lying in a horizontal plane, means mounting said casing for rotation about a vertical axis that is perpendicular to the horizontal plane of said lower end opening, bed plate means supported below and in substantial parallelism with said horizontal plane of said lower end opening and having an elongated port extending generally radially outwardly from said vertical axis, a cutting mill having radially extending blades, said mill being mounted for rotating about a horizontal axis in parallel with said plane, the blades of said cutting mill projecting through said port for performing a cutting action on bales bearing on said bed plate means, bale guide means mounted to the inside of said casing for permitting the bottom surfaces of a plurality of bales to interface with said bed plate means and for constraining said bales to orbit in a circular path that is concentric to and non-overlapping of said vertical axis such that the entire area of the bottom surface of each bale is constrained to sweep over said cutting mill when said casing is rotating, and means for driving said casing and cutting mill rotationally.

3. The apparatus defined in any of claims 1 or 2 wherein said guide means comprise sets of vertically extending guide elements each of which is arranged and configured to engage the corners, respectively, of a bale to enable said bales to be driven orbitally when said casing is rotated, means supporting said guide elements for being selectively adjusted toward and away from said casing, respectively, to thereby accommodate bales of different sizes.

* * * * *